US009180577B2

(12) United States Patent
Heath

(10) Patent No.: US 9,180,577 B2
(45) Date of Patent: Nov. 10, 2015

(54) SPINDLE REMOVAL TOOL

(71) Applicant: William C. Heath, Hephzibah, GA (US)

(72) Inventor: William C. Heath, Hephzibah, GA (US)

( * ) Notice: Subject to any disclaimer, the term of this patent is extended or adjusted under 35 U.S.C. 154(b) by 286 days.

(21) Appl. No.: 13/745,772

(22) Filed: Jan. 19, 2013

(65) Prior Publication Data

US 2014/0201962 A1 Jul. 24, 2014

(51) Int. Cl.
*B25B 27/00* (2006.01)
*B25B 11/02* (2006.01)

(52) U.S. Cl.
CPC ..... *B25B 11/02* (2013.01); *Y10T 29/53991* (2015.01)

(58) Field of Classification Search
USPC ..... 29/283, 270, 278, 242, 255, 281.1, 252; 269/3, 6; 254/2 B, 133 R, 134
See application file for complete search history.

(56) References Cited

U.S. PATENT DOCUMENTS

| | | | | |
|---|---|---|---|---|
| 4,283,827 | A * | 8/1981 | Abel | 29/254 |
| 4,302,873 | A | 12/1981 | Rotman | |
| 4,733,450 | A * | 3/1988 | Pool | 29/254 |
| 4,771,528 | A * | 9/1988 | Stromberg | 29/259 |
| 5,127,638 | A * | 7/1992 | Kent | 269/17 |
| 6,581,265 | B2 | 6/2003 | Sawaya | |
| 2008/0060183 | A1 * | 3/2008 | Walker | 29/255 |
| 2008/0168641 | A1 * | 7/2008 | Cao | 29/270 |

* cited by examiner

*Primary Examiner* — Joseph J Hail
*Assistant Examiner* — J. Stephen Taylor
(74) *Attorney, Agent, or Firm* — Kenneth Buffington

(57) ABSTRACT

The spindle removal tool is a device for removing, supporting, and moving an entire spindle assembly from semi trucks. It is easier to perform maintenance on the spindle assembly after removing it from the truck. The apparatus is primarily a flat semicircular plate with openings that match the bolt pattern of a semi truck's hub. The plate is bolted to the rim and the entire spindle assembly is disconnected from the truck's axle. The semicircular plate is attached to a support bar that is raised or lowered with a floor jack. The mechanic can roll the entire spindle assembly from underneath the truck and perform maintenance on the shop floor.

8 Claims, 4 Drawing Sheets

SPINDLE REMOVAL TOOL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates generally to the maintenance of semi trucks, and more specifically to a tool for removing, supporting, and moving an entire spindle assembly from a semi truck axle shaft. The entire spindle assembly includes the spindle, bearings, washers, hub cap, and hub.

2. Background of the Invention

There are many patents related to spindle puller tools indicating the wide scope of such inventions. Numerous spindle puller tools have been provided in the prior art that are adapted to remove the wheel spindles from the axle shafts of motor vehicles. For example, U.S. Pat. No. 4,283,827 to Abel; U.S. Pat. No. 4,302,873 to Rotman; U.S. Pat. No. 4,562,631 to Welch; U.S. Pat. No. 4,733,450 to Pool and U.S. Pat. No. 4,771,528 to Stromberg all are illustrative of such prior art. While these units are designed as spindle pullers they would not be as suitable for the purpose of removing, supporting, and moving an entire spindle assembly from semi trucks. It is easier to perform maintenance on the spindle assembly after removing it from the truck. However, the spindle assembly on semi trucks may weigh in excess of 200 lbs. so it is difficult to manually lift and move. It typically requires two mechanics to manually lift and move the entire spindle assembly, but only one mechanic is required with the spindle removal tool.

SUMMARY OF THE INVENTION

The present invention comprises a flat semicircular plate with openings that match the bolt pattern of a semi truck's hub. The semicircular plate is attached to a support bar that is raised or lowered with a floor jack. The plate is bolted to the hub and the entire spindle assembly is disconnected from the truck's axle. The mechanic can roll the entire spindle assembly from underneath the truck and perform maintenance on the shop floor.

BRIEF DESCRIPTION OF THE DRAWINGS

Referring now to the drawings in which like reference numbers represent corresponding parts throughout.

DETAILED DESCRIPTION OF THE INVENTION

Figure 1:
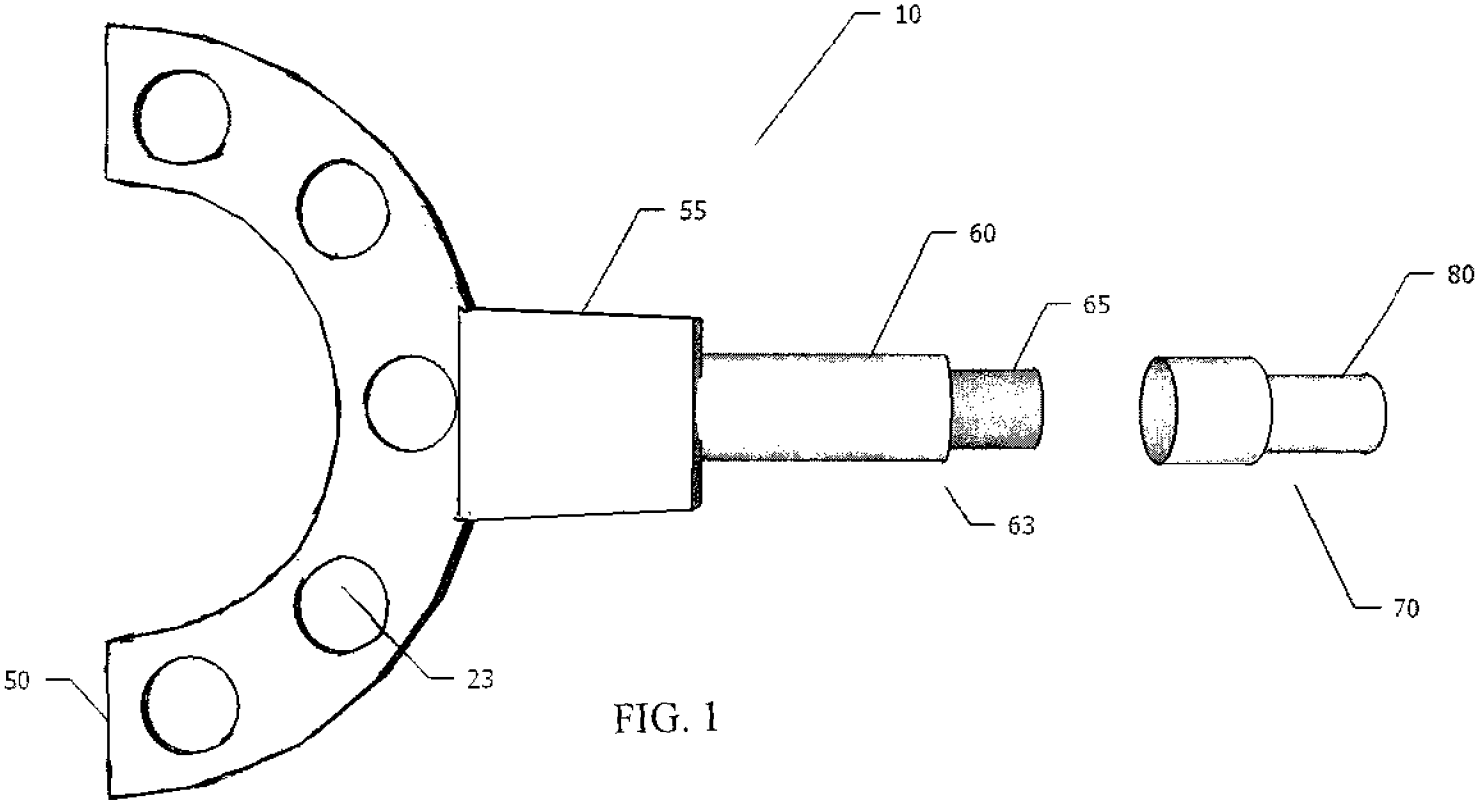
FIG. 1 is a top side perspective view of the spindle removal tool according to a preferred embodiment of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Figure 2:
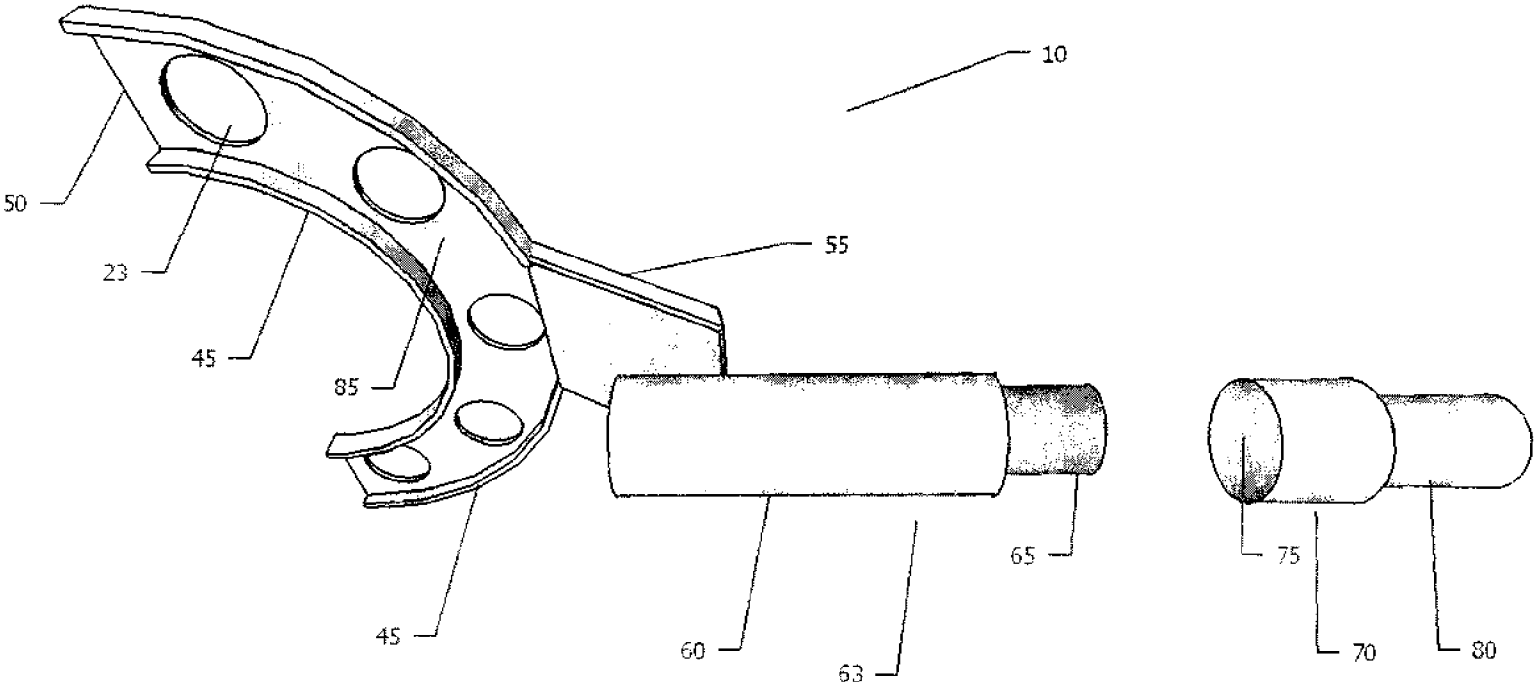
FIG. 2 is an isometric perspective view of the spindle removal tool according to a preferred embodiment of the present invention.
Figure 3:
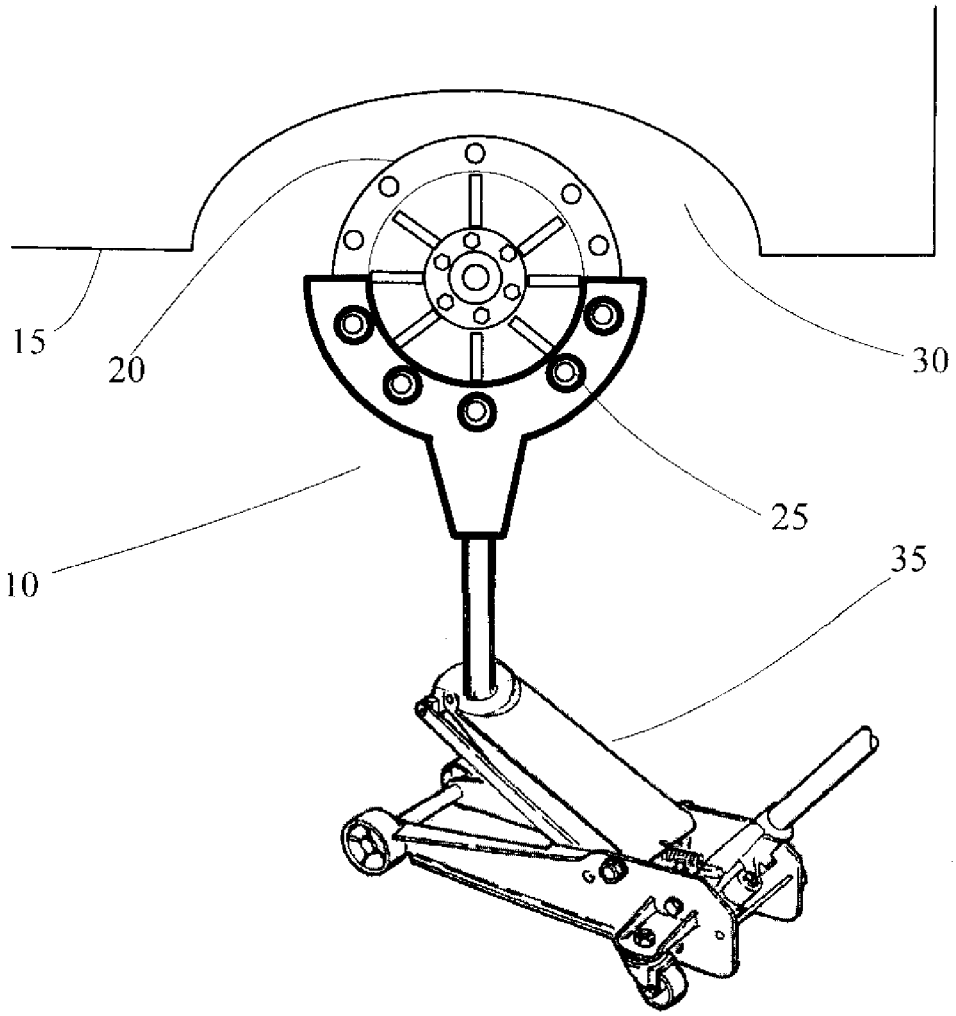
FIG. 3 is a side perspective view of the spindle removal tool underneath a wheel well according to a preferred embodiment of the present invention.
Figure 4:
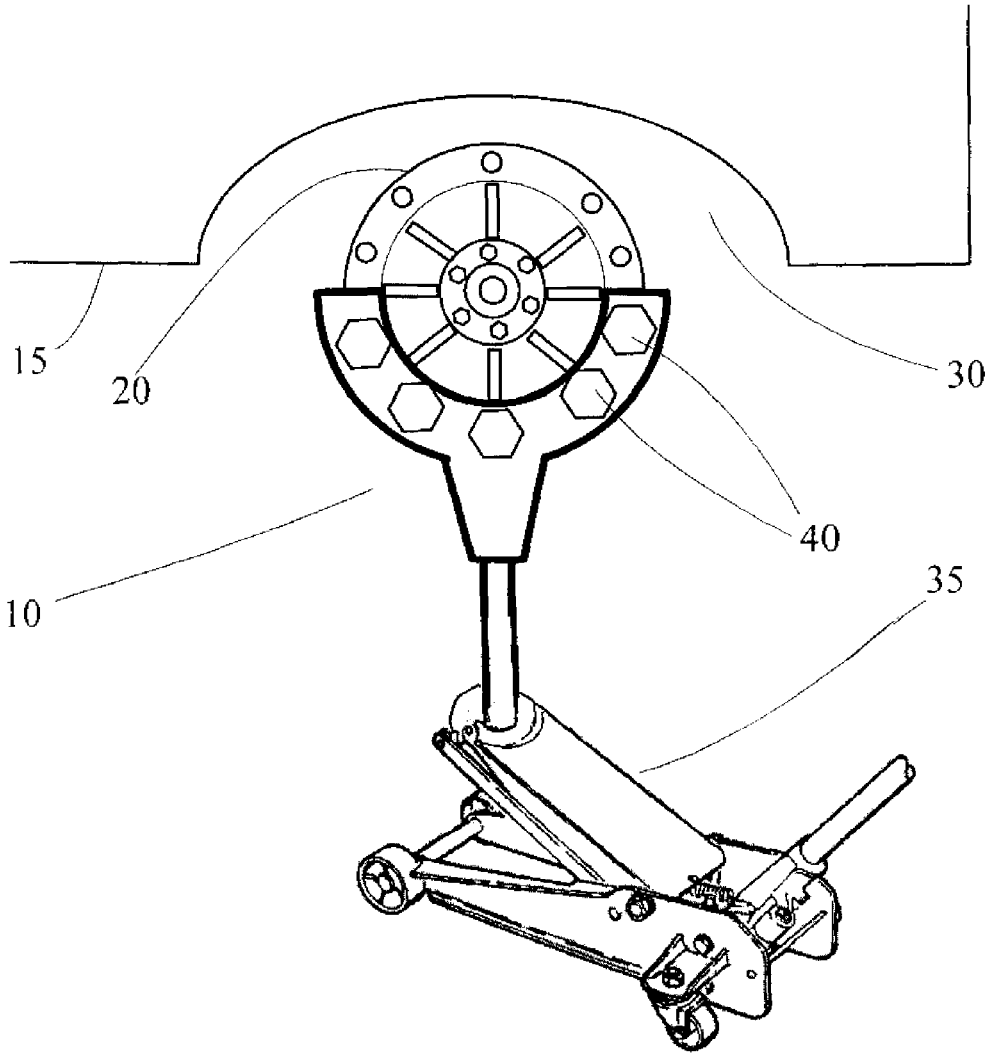
FIG. 4 is a side perspective view of the spindle removal tool bolted in place underneath a wheel well according to a preferred embodiment of the present invention.

Referring now to the drawings, the spindle removal tool, designated broadly at 10, is illustrated in FIGS. 1-4. The spindle removal tool 10 primarily consists of three major metallic sections: top, middle, and bottom. As shown in FIGS. 3 and 4, these three sections are aligned on a vertical axis to produce a nearly Y-shaped structure.

Referring to FIGS. 1-4, the spindle removal tool 10 of the present invention includes a semicircular plate 50 with circular holes 23 or openings that extend through the plate 50. The radius and size of openings 23 in the plate 50 are sized to match the bolt pattern of the vehicle's wheel hub 20. The openings 23 are equally space around the circumference of the bolt circle on the hub 20. There are five openings in the present invention. Although there are typically five openings, it is possible that there be more or less depending on the specific bolt pattern of the vehicle's wheel hub 20. As shown in FIG. 2, the semicircular plate 50 typically includes ledges 45 along the perimeter to provide additional vertical support. Typically, the ledges 45 project out approximately ¼ inch. The ledges 45 may project out perpendicular from the plate 50 or may project out in the form of a curve.

A transitional plate 55 is attached to the lowest segment of a vertical semicircular plate 50 on one end, and the junction is preferably welded together. However, any secure method of attachment is satisfactory. The other end of the transitional plate 55 is attached to a support bar 63. Again, the junction is preferably welded together, but any secure method of attachment is satisfactory. The transitional plate is a means by which the semicircular plate 50 attaches to the support bar 63. The support bar 63 includes a wide member 60 and a narrow member 65. The transition plate 55 is preferably offset to the support bar 63 via an approximate 45 degree angle. The offset keeps the space directly under the vehicle's wheel free and clear, thereby allowing a wider range of vertical movement.

The wide member 60 is preferably a solid round metal bar. The wide member 60 of the support bar 63 is attached to the transition plate 55. On the narrow member 65 of the support bar 63, a metallic coupler extension 70 is provided to attach to a standard floor jack 35 in order to raise or lower the spindle removal tool 10 as necessary. The coupler extension 70 is provided with an open hollow end 75 and a solid end 80. The narrow end 65 of the support bar 63 fits snuggly inside the open hollow end 75 of the coupler extension 70. The narrow end 65 of the support bar 63 and the solid end 80 of the coupler extension 70 are formed by milling the materials down to appropriate size. The solid end 80 of the coupler extension 70 is provided in various widths to accommodate the fittings in different floor jacks 35.

As best shown in FIGS. 3 and 4, the spindle removal tool 10 is shown in position inside the wheel well 30 of a semi truck 15. The inner surface 85 of the semicircular plate 50 is in direct contact with the flat surface of the hub 20. There are five hub bolts 25 protruding through the semicircular plate 50 openings 23. The spindle removal tool 10 is supported by a floor jack 35. In FIG. 4, the spindle removal tool 10 is shown securely fastened in place against the hub 20 by five lug nuts 40.

In operation, the mechanic places the spindle removal tool 10 on the floor jack 35 and rolls the spindle removal tool 10 in position near the hub 20. The height is adjusted with the floor jack 35 so that the openings 23 align with the bolts 25 on the hub 20. As shown in FIG. 3, the floor jack 35 is rolled so that the inner contact surface 85 of the semicircular plate 50 is in direct contact with the surface of the hub 20. As shown in FIG. 4, the lug nuts 40 are threaded on the hub bolts 25 and tightened in place. The mechanic disconnects the entire spindle assembly from inside the wheel well 30. After the entire spindle assembly is free, the mechanic uses the floor jack 35 to roll the spindle removal tool 10 along with the entire spindle assembly to another area on the shop floor.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. For example, the spindle removal tool 10 could be molded in a single piece without any welds. Ledges 45 may project out from the plate 50 in the form of a curve or ledges 45 may not be present at all. The transitional plate 55 may not be present. The spindle removal tool 10 may be designed for different size hubs 20 and bolt 25 patterns. The spindle removal tool 10 may be made of any suitable material capable of bearing the weight of an entire spindle assembly. Accordingly, all such modifications are intended to be included within the scope of this invention as defined in the claims.

I claim:

1. A spindle removal tool which comprises:

(a.) a flat semicircular plate with symmetrically spaced openings extending through said plate as a top section;

(b.) a transitional plate offset approximately 45 degrees from the vertical axis securely attached to the lowest segment of said semicircular plate as a middle section;

(c.) a support bar securely attached to said transitional plate as a bottom section; and (d.) whereby the top, middle, and bottom sections are aligned on a vertical axis in a nearly Y-shape structure.

2. The tool as claimed in claim 1, wherein said semicircular plate is provided with five openings to accommodate a semi truck's lug bolts.

3. The tool as in claim 1, wherein an end of said support bar opposite said semicircular plate is narrower than an end of said support bar closest to said plate.

4. A spindle removal tool which comprises:

(a.) a flat semicircular plate with five symmetrically spaced openings extending through said plate as a top section;

(b.) a transitional plate offset approximately 45 degrees from the vertical axis welded to the lowest segment of said semicircular plate as a middle section;

(c.) a support bar welded to said transitional plate as a bottom section; and (d.) whereby the top, middle, and bottom sections are aligned on a vertical axis in a nearly Y-shape structure.

5. The tool as in claim 4, wherein an end of said support bar opposite said semicircular plate is narrower than an end of said support bar closest to said plate.

6. A spindle removal tool which comprises:

(a.) a top section comprising a flat semicircular plate with symmetrically spaced openings extending through said plate;

(b.) a middle section comprising a means to securely offset approximately 45 degrees from the vertical axis and attach a lowest segment of said top section to a bottom section;

(c.) said bottom section comprising a support bar; and (d.) whereby the top, middle, and bottom sections are aligned on a vertical axis in a nearly Y-shape structure.

7. The tool as claimed in claim 6, wherein said means to securely offset and attach the lowest segment of said top section to a bottom section is a transitional plate.

8. The tool as in claim 6, wherein an end of said support bar opposite said semicircular plate is narrower than an end of said support bar closest to said plate.

* * * * *